US011516898B2

(12) United States Patent
He

(10) Patent No.: US 11,516,898 B2
(45) Date of Patent: Nov. 29, 2022

(54) THYRISTOR REGULATION CIRCUIT FOR HIGH-VOLTAGE LED STRIP LIGHT

(71) Applicant: General Lighting Electronic Co., Ltd, Zhongshan (CN)

(72) Inventor: Zhiliang He, Guangzhou (CN)

(73) Assignee: General Lighting Electronic Co., Ltd, Zhongshan (CN)

( * ) Notice: Subject to any disclaimer, the term of this patent is extended or adjusted under 35 U.S.C. 154(b) by 0 days.

(21) Appl. No.: 17/711,124

(22) Filed: Apr. 1, 2022

(65) Prior Publication Data

US 2022/0232676 A1 Jul. 21, 2022

Related U.S. Application Data

(63) Continuation of application No. PCT/CN2020/124499, filed on Oct. 28, 2020.

(30) Foreign Application Priority Data

May 6, 2020 (CN) ..... 202020723315.X

(51) Int. Cl.
*H05B 45/10* (2020.01)
*F21V 23/00* (2015.01)
(Continued)

(52) U.S. Cl.
CPC ..... *H05B 45/10* (2020.01); *F21V 23/003* (2013.01); *H05B 45/20* (2020.01); *H05B 45/37* (2020.01)

(58) Field of Classification Search
CPC ..... H05B 45/10; H05B 45/20; H05B 45/37; F21V 23/003
See application file for complete search history.

(56) References Cited

U.S. PATENT DOCUMENTS

2017/0164434 A1 6/2017 Xiong et al.
2018/0220502 A1* 8/2018 Morales ..... H05B 45/48
(Continued)

FOREIGN PATENT DOCUMENTS

CN 104507227 A 4/2015
CN 204305425 U 4/2015
(Continued)

OTHER PUBLICATIONS

Internation Search Report of PCT/CN2020/124499, dated Jan. 27, 2021.

*Primary Examiner* — Minh D A

(57) ABSTRACT

A thyristor regulation circuit for a high-voltage light-emitting diode (LED) strip light includes: a live wire input terminal, a neutral wire input terminal, a full-bridge rectifier module, a first group of LED circuit modules, a second group of LED circuit modules, a third group of LED circuit modules, a first thyristor chip, a second thyristor chip and a third thyristor chip. The LED strip light includes a plurality of minimum LED strip light units, the minimum LED strip light units are arranged in parallel, and each of the minimum LED strip light units includes the thyristor regulation circuit for a high-voltage LED strip light. In the thyristor regulation circuit, an external bulky power supply is omitted, and an LED strip light is directly connected to the mains electricity for use, thereby reducing the installation difficulty; and the present disclosure is compatible with existing thyristor dimming circuits.

7 Claims, 3 Drawing Sheets

(51) Int. Cl.
*H05B 45/37* (2020.01)
*H05B 45/20* (2020.01)

(56) References Cited

U.S. PATENT DOCUMENTS

| | | | | |
|---|---|---|---|---|
| 2019/0098730 | A1* | 3/2019 | Fukuda | H05B 45/20 |
| 2020/0116315 | A1 | 4/2020 | Zhao | |
| 2020/0149689 | A1 | 5/2020 | Xiong et al. | |

FOREIGN PATENT DOCUMENTS

| | | | |
|---|---|---|---|
| CN | 207744209 | U | 8/2018 |
| CN | 111615235 | A | 9/2020 |

* cited by examiner

THYRISTOR REGULATION CIRCUIT FOR HIGH-VOLTAGE LED STRIP LIGHT

CROSS-REFERENCE TO RELATED APPLICATIONS

This application is a continuation of International Patent Application No. PCT/CN2020/124499 with of filing date of Oct. 28, 2020, designating the United States, now pending, and further claims priority to Chinese Patent Application No. 202020723315.X with a filing date of May 6, 2020. The content of the aforementioned applications, including any intervening amendments thereto, are incorporated herein by reference.

TECHNICAL FIELD

The present disclosure relates to the technical field of electronic circuits, and particularly relates to a thyristor regulation circuit for a high-voltage light-emitting diode (LED) strip light.

BACKGROUND ART

At present, an existing high-voltage LED strip light generally can support thyristor dimming, and thyristors are generally connected in series in a circuit in a front tangent or rear tangent mode and can be connected to an LED strip light with two color loops. However, there is an extremely narrow dimming range, and it is impossible to achieve dimming and color temperature adjustment at the same time. An LED strip light capable of adjusting a color temperature generally needs two color loops, and colors are mixed to achieve color temperature adjustment. In this case, the two loops are generally connected in a common positive or negative mode, and at least three lines are required to achieve the connection. If three lines are applied to the LED strip light, the cost is increased, the width of the LED strip light is increased, and the brightness and color temperature cannot be controlled by the thyristors.

SUMMARY

Based on this, it is necessary to provide a thyristor regulation circuit for a high-voltage LED strip light in view of the above technical problems.

A thyristor regulation circuit for a high-voltage LED strip light includes: a live wire input terminal, a neutral wire input terminal, a full-bridge rectifier module, a first group of LED circuit modules, a second group of LED circuit modules, a third group of LED circuit modules, a first thyristor chip, a second thyristor chip and a third thyristor chip. The live wire input terminal is connected with a first input terminal of the full-bridge rectifier module, the neutral wire input terminal is connected with a second input terminal of the full-bridge rectifier module, a first output terminal of the full-bridge rectifier module is connected with an input terminal of the first group of LED circuit modules, an output terminal of the first group of LED circuit modules is separately connected with an input terminal of the second group of LED circuit modules and an input terminal of the first thyristor chip, an output terminal of the second group of LED circuit modules is separately connected with an input terminal of the third group of LED circuit modules and an input terminal of the second thyristor chip, and an output terminal of the third group of LED circuit modules is connected with an input terminal of the third thyristor chip. An output terminal of the first thyristor chip, an output terminal of the second thyristor chip and an output terminal of the third thyristor chip are connected to each other and are all grounded. The first group of LED circuit modules includes a first parallel group and a second parallel group that are formed by a plurality of first LED lamps, the first LED lamps in the first parallel group are connected in parallel, the first LED lamps in the second parallel group are connected in parallel, the first parallel group and the second parallel group are connected in series, an anode of each of the first LED lamps in the first parallel group is the input terminal of the first group of LED circuit modules, and a cathode of each of the first LED lamps in the second parallel group is the output terminal of the first group of LED circuit modules. The second group of LED circuit modules includes a third parallel group, a fourth parallel group and a fifth parallel group that are formed by a plurality of second LED lamps, the second LED lamps in the third parallel group are connected in parallel, the second LED lamps in the fourth parallel group are connected in parallel, the second LED lamps in the fifth parallel group are connected in parallel, the third parallel group, the fourth parallel group and the fifth parallel group are connected in series in sequence, an anode of each of the second LED lamps in the third parallel group is the input terminal of the second group of LED circuit modules, and a cathode of each of the second LED lamps in the fifth parallel group is the output terminal of the second group of LED circuit modules. The third group of LED circuit modules includes a sixth parallel group, a seventh parallel group and an eighth parallel group that are formed by a plurality of third LED lamps, the third LED lamps in the sixth parallel group are connected in parallel, the third LED lamps in the seventh parallel group are connected in parallel, the third LED lamps in the eighth parallel group are connected in parallel, the sixth parallel group, the seventh parallel group and the eighth parallel group are connected in series in sequence, an anode of each of the third LED lamps in the sixth parallel group is the input terminal of the third group of LED circuit modules, and a cathode of each of the third LED lamps in the eighth parallel group is the output terminal of the third group of LED circuit modules. The number of the first LED lamps, the number of the second LED lamps and the number of the third LED lamps are equal, the number of the first LED lamps in the first parallel group is equal to the number of the first LED lamps in the second parallel group, the number of the second LED lamps in the third parallel group, the number of the second LED lamps in the fourth parallel group, the number of the second LED lamps in the fifth parallel group, the number of the third LED lamps in the sixth parallel group, the number of the third LED lamps in the seventh parallel group, and the number of the third LED lamps in the eighth parallel group are equal, and the number of the second LED lamps in the third parallel group is ⅔ of the number of the first LED lamps in the first parallel group.

In one of the embodiments, a second output terminal of the full-bridge rectifier module is grounded.

In one of the embodiments, the output terminal of the first thyristor chip includes a first resistor, a first output branch terminal 1 and a first output branch terminal 2, and the first output branch terminal 1 is connected with the first output branch terminal 2 through the first resistor and grounded.

In one of the embodiments, the output terminal of the second thyristor chip includes a second resistor, a second output branch terminal 1 and a second output branch terminal 2, and the second output branch terminal 1 is connected with the second output branch terminal 2 through the second resistor and connected with the first output branch terminal 1.

In one of the embodiments, the output terminal of the third thyristor chip includes a third resistor, a third output branch terminal 1 and a third output branch terminal 2, and the third output branch terminal 1 is connected with the third output branch terminal 2 through the third resistor and connected with the second output branch terminal 1.

In one of the embodiments, the number of the first LED lamps is six, the number of the first LED lamps in the first parallel group is three, and the number of the second LED lamps in the third parallel group is two.

An LED strip light includes a plurality of minimum LED strip light units, the minimum LED strip light units are arranged in parallel, and each of the minimum LED strip light units includes the thyristor regulation circuit for a high-voltage LED strip light as described in any one of the above embodiments. The live wire input terminals are connected to each other, the neutral wire input terminals are connected to each other, each of the first LED lamps, each of the second LED lamps and each of the third LED lamps are attached in one of the minimum LED strip light units, each of the first LED lamps is closely attached to one of the second LED lamps correspondingly, and each of the second LED lamps is closely attached to one of the third LED lamps correspondingly.

The above thyristor regulation circuit for a high-voltage LED strip light solves the defects in applications of existing LED strip lights. An external bulky power supply is omitted, and an LED strip light is directly connected to the mains electricity for use, that is, the LED strip light does not need to be driven, thereby reducing the installation difficulty. The present disclosure can be well used in a narrow space, and is not limited by the magnitude of the power supply and the power adaptation. The present disclosure is compatible with existing thyristor dimming circuits, thereby saving the use cost. The present disclosure conforms to the biological principle of the human body, provides good brightness and color temperature when working to make the working mood comfortable, and is warm and easeful when resting to make the body relax better. When the LED strip light is used reasonably, the LED strip light works at full power during the day, and the voltage is reduced at night to make people feel comfortable and easeful, so that energy saving and environmental protection are realized, and the light pollution is reduced. The realization of the above benefits is concentrated on the same LED strip light, the use is simple and convenient, and the market use potential is huge.

DETAILED DESCRIPTION OF THE EMBODIMENTS

To make the foregoing objectives, features, and advantages of the present disclosure clearer and more comprehensible, the specific implementations of the present disclosure are described in detail below with reference to the drawings. The following describes many details in order to provide a thorough understanding of the present disclosure. However, the present disclosure can be implemented in many other ways other than those described herein. Those skilled in the art can make similar improvements without departing from the connotation of the present disclosure, and thus, the present disclosure is not limited to the specific embodiments disclosed below.

Figure 1:
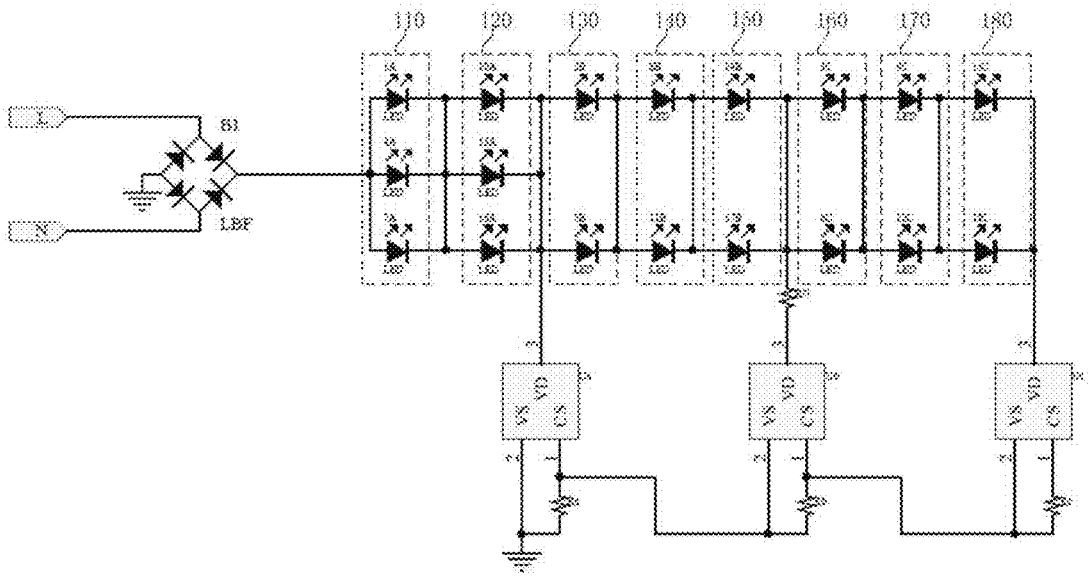
FIG. 1 shows a schematic structural diagram of a thyristor regulation circuit for a high-voltage LED strip light in one embodiment.

Referring to FIG. 1, the present disclosure provides a thyristor regulation circuit for a high-voltage LED strip light. The thyristor regulation circuit for a high-voltage LED strip light includes: a live wire input terminal L, a neutral wire input terminal N, a full-bridge rectifier module B1, a first group of LED circuit modules, a second group of LED circuit modules, a third group of LED circuit modules, a first thyristor chip Ua, a second thyristor chip Ub and a third thyristor chip Uc. The live wire input terminal L is connected with a first input terminal of the full-bridge rectifier module B1, the neutral wire input terminal N is connected with a second input terminal of the full-bridge rectifier module B1, a first output terminal of the full-bridge rectifier module B1 is connected with an input terminal of the first group of LED circuit modules, an output terminal of the first group of LED circuit modules is separately connected with an input terminal of the second group of LED circuit modules and an input terminal of the first thyristor chip Ua, an output terminal of the second group of LED circuit modules is separately connected with an input terminal of the third group of LED circuit modules and an input terminal of the second thyristor chip Ub, and an output terminal of the third group of LED circuit modules is connected with an input terminal of the third thyristor chip Uc. An output terminal of the first thyristor chip Ua, an output terminal of the second thyristor chip Ub and an output terminal of the third thyristor chip Uc are connected to each other and are all grounded. The first group of LED circuit modules includes a first parallel group 110 and a second parallel group 120 that are formed by a plurality of first LED lamps, the first LED lamps in the first parallel group 110 are connected in parallel, the first LED lamps in the second parallel group 120 are connected in parallel, the first parallel group 110 and the second parallel group 120 are connected in series, an anode of each of the first LED lamps in the first parallel group 110 is the input terminal of the first group of LED circuit modules, and a cathode of each of the first LED lamps in the second parallel group 120 is the output terminal of the first group of LED circuit modules. The second group of LED circuit modules includes a third parallel group 130, a fourth parallel group 140 and a fifth parallel group 150 that are formed by a plurality of second LED lamps, the second LED lamps in the third parallel group 130 are connected in parallel, the second LED lamps in the fourth parallel group 140 are connected in parallel, the second LED lamps in the fifth parallel group 150 are connected in parallel, the third parallel group 130, the fourth parallel group 140 and the fifth parallel group 150 are connected in series in sequence, an anode of each of the second LED lamps in the third parallel group 130 is the input terminal of the second group of LED circuit modules, and a cathode of each of the second LED lamps in the fifth parallel group 150 is the output terminal of the second group of LED circuit modules. The third group of LED circuit modules includes a sixth parallel group 160, a seventh parallel group 170 and an eighth parallel group 180 that are formed by a plurality of third LED lamps, the third LED lamps in the sixth parallel group 160 are connected in parallel, the third LED lamps in the seventh parallel group 170 are connected in parallel, the third LED lamps in the eighth parallel group 180 are connected in parallel, the sixth parallel group 160, the seventh parallel group 170 and the eighth parallel group 180 are connected in series in sequence, an anode of each of the third LED lamps in the sixth parallel group 160 is the input terminal of the third group of LED circuit modules, and a cathode of each of the third LED lamps in the eighth parallel group 180 is the output terminal of the third group of LED circuit modules. The number of the first LED lamps, the number of the second LED lamps and the number of the third LED lamps are equal, the number of the first LED lamps in the first parallel group 110 is equal to the number of the first LED lamps in the second parallel group 120, the number of the second LED lamps in the third parallel group 130, the number of the second LED lamps in the fourth parallel group 140, the number of the second LED lamps in the fifth parallel group 150, the number of the third LED lamps in the sixth parallel group 160, the number of the third LED lamps in the seventh parallel group 170, and the number of the third LED lamps in the eighth parallel group 180 are equal, and the number of the second LED lamps in the third parallel group 130 is ⅔ of the number of the first LED lamps in the first parallel group 110.

The above thyristor regulation circuit for a high-voltage LED strip light solves the defects in applications of existing LED strip lights. An external bulky power supply is omitted, and an LED strip light is directly connected to the mains electricity for use, that is, the LED strip light does not need to be driven, thereby reducing the installation difficulty. The present disclosure can be well used in a narrow space, and is not limited by the magnitude of the power supply and the power adaptation. The present disclosure is compatible with existing thyristor dimming circuits, thereby saving the use cost. The present disclosure conforms to the biological principle of the human body, provides good brightness and color temperature when working to make the working mood comfortable, and is warm and easeful when resting to make the body relax better. When the LED strip light is used reasonably, the LED strip light works at full power during the day, and the voltage is reduced at night to make people feel comfortable and easeful, so that energy saving and environmental protection are realized, and the light pollution is reduced. The realization of the above benefits is concentrated on the same LED strip light, the use is simple and convenient, and the market use potential is huge.

In one of the embodiments, a second output terminal of the full-bridge rectifier module B1 is grounded.

In one of the embodiments, the output terminal of the first thyristor chip Ua includes a first resistor, a first output branch terminal 1 and a first output branch terminal 2, and the first output branch terminal 1 is connected with the first output branch terminal 2 through the first resistor and grounded.

In one of the embodiments, the output terminal of the second thyristor chip Ub includes a second resistor, a second output branch terminal 1 and a second output branch terminal 2, and the second output branch terminal 1 is connected with the second output branch terminal 2 through the second resistor and connected with the first output branch terminal 1.

In one of the embodiments, the output terminal of the third thyristor chip Uc includes a third resistor, a third output branch terminal 1 and a third output branch terminal 2, and the third output branch terminal 1 is connected with the third output branch terminal 2 through the third resistor and connected with the second output branch terminal 1.

Figure 2:
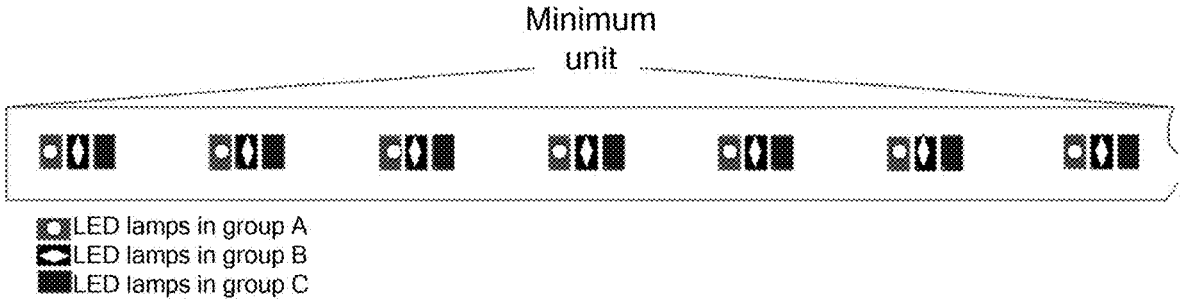
FIG. 2 shows a schematic structural diagram of another viewing angle of the thyristor regulation circuit for a high-voltage LED strip light in the embodiment shown in FIG. 1.

It is worth mentioning that, as shown in FIG. 2, the present disclosure further provides an LED strip light. The LED strip light includes a plurality of minimum LED strip light units, the minimum LED strip light units are arranged in parallel, and each of the minimum LED strip light units includes the thyristor regulation circuit for a high-voltage LED strip light as described in any one of the above embodiments. The live wire input terminals L are connected to each other, the neutral wire input terminals N are connected to each other, each of the first LED lamps, each of the second LED lamps and each of the third LED lamps are attached in one of the minimum LED strip light units, each of the first LED lamps is closely attached to one of the second LED lamps correspondingly, and each of the second LED lamps is closely attached to one of the third LED lamps correspondingly.

In one of the embodiments, the number of the first LED lamps is six, the number of the first LED lamps in the first parallel group 110 is three, and the number of the second LED lamps in the third parallel group 130 is two. Specifically, in the present disclosure, the LED lamps are divided into three groups, namely a group A, a group B and a group C, which are respectively controlled by three ICs, namely the first thyristor chip Ua, the second thyristor chip Ub and the third thyristor chip Uc, and the three groups of ICs are connected in series as shown in FIG. 1. Of course, here, the LED lamps are not limited to only three groups, and multiple groups of LED lamps may be provided. However, if the LED lamps are less than three groups, the effect is not good, that is, if the LED lamps are less than three groups, the illuminating effect is poor. The group A consists of six LED lamps including two strings of three parallel LED lamps, the group B consists of six LED lamps including three strings of two parallel LED lamps, and the group C consists of six LED lamps including three strings of two parallel LED lamps. Here, the selection of the voltage of the LED lamps depends on the matching with the input voltage, and the number of the LED lamps is not limited to six. The number is designed according to the matching of the input voltage and the voltage of the LED lamps. However, the number of the LED lamps in the group A, the group B and the group C is required to be the same. Of course, here, the number of groups is not limited. Four groups or more groups of LED lamps may be provided, as long as the number of the LED lamps in all groups is the same.

The thyristor regulation circuit for a high-voltage LED strip light of the present disclosure is applied to an LED strip light. Since the LED strip light is linear, the distribution of the LED lamps is also linear, and then, the entire line is required to emit light evenly when the LED lamps work. In the present disclosure, first, six LED lamps in the group A are evenly distributed in a set length space; secondly, six LED lamps in the group B are evenly distributed in the set length space, and the LED lamps in the group B are closely attached to the LED lamps in the group A; and then, six LED lamps in the group C are evenly distributed in the set length space, and the LED lamps in the group C are closely attached to the LED lamps in the group B. In this way, the three groups of LED lamps are evenly distributed in the set length space to form a minimum unit for the LED strip light to work. The LED strip light may be that are formed by countless such units, and the minimum unit may be set as required.

During the circuit design in the present disclosure, the LED lamps in the group A, the group B and the group C may be pasted with one color, so that when the circuit works, the brightness can be adjusted by a thyristor. For example, when the voltage is low, only the LED lamps in the group A work for emitting light; when the voltage rises, the LED lamps in the group B also work for emitting light, and the LED lamps in the group A continue to work; and when the voltage is normal, the LED lamps in the group C also work for emitting light, and the LED lamps in the group A and the group B continue to work for emitting light. During the circuit design, the LED lamps in the group A can be pasted as LED lamps with a low color temperature, and the LED lamps in the group B and the group C can be pasted as LED lamps with a high color temperature. In this way, when the circuit works, the thyristor can be configured to adjust the brightness and the color temperature at the same time. For example, when the voltage is low, only the LED lamps in the group A work for emitting light, and at this time, the LED lamps emit the light with a low color temperature; when the voltage rises, the LED lamps in the group B also work for emitting light, the LED lamps in the group A continue to work, however, the LED lamps in the group B emit the light with a high color temperature, and with the increase of the voltage, the light with a high color temperature is mixed with the light with a low color temperature to change the color temperature of the LED strip light; and when the voltage is normal, the LED lamps in the group C also work for emitting light, the LED lamps in the group A and the group B continue to work for emitting light, and the LED lamps in the group B and the group C emit the light with a high color temperature. In this way, under the condition of the same luminous efficacy, the light emitted by two groups of LED lamps with a high color temperature is mixed with the light emitted by one group of LED lamps with a low color temperature to realize the change of the color temperature from low to high, and at the same time, the brightness is also changed. Preferably, in the design of one embodiment, when the voltage is low, the LED lamps with a low color temperature are turned on, and when the voltage is normal, the LED lamps with a high color temperature are turned on. This is because when people work, a higher color temperature and brightness are needed (referring to the daylight during the day); and when people need to rest at home at night, the voltage can be reduced, the LED strip light also emits the light with a low color temperature, the brightness is also low (because the LED lamps in the group B and the group C are not turned on), and then, people can feel warm and easeful in the environment with a low color temperature (warm color) and can easily rest comfortably, thereby conforming to the modern design. Of course, here, the present disclosure is not limited to this design. The color and color temperature of the LED lamps in the group A, the group B and the group C may be matched randomly, and the number of groups is not limited to three. However, the premise is that the number of LED lamps in multiple groups is the same, so that the linear design of the LED strip light can be realized.

Figure 3:
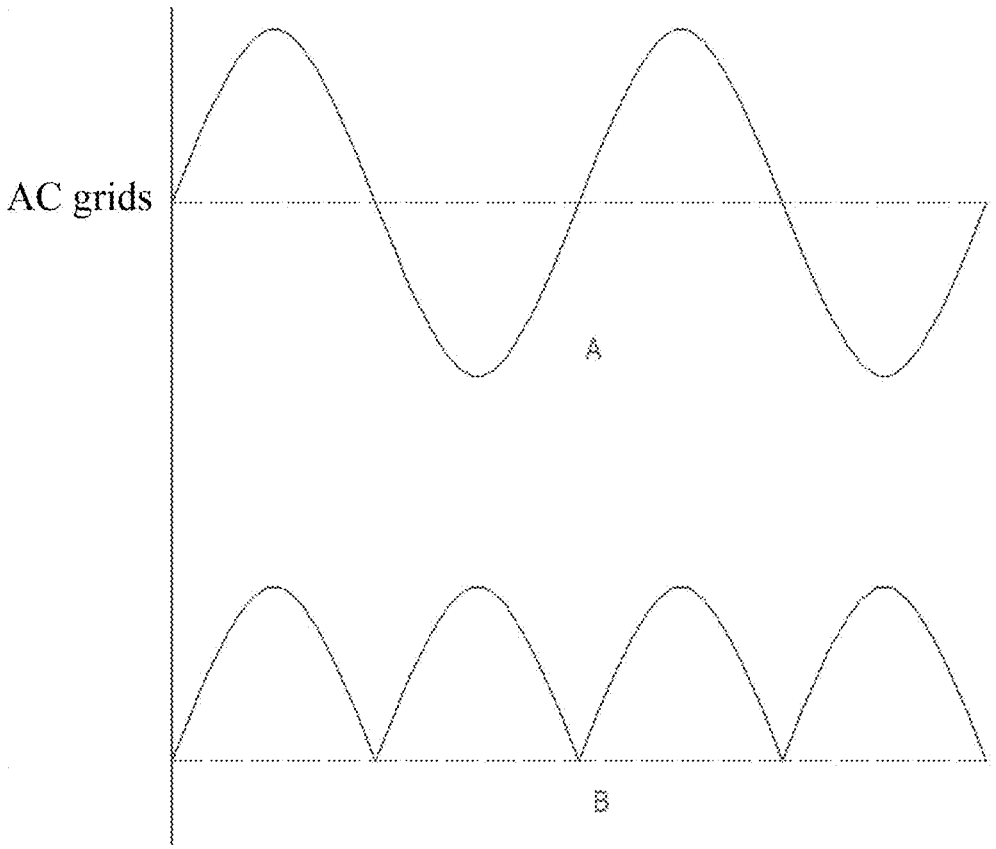
FIG. 3 shows a schematic diagram of a voltage waveform of AC mains electricity and a schematic diagram of a pulsating DC voltage waveform after rectification by a full-bridge rectifier module.
Figure 4:
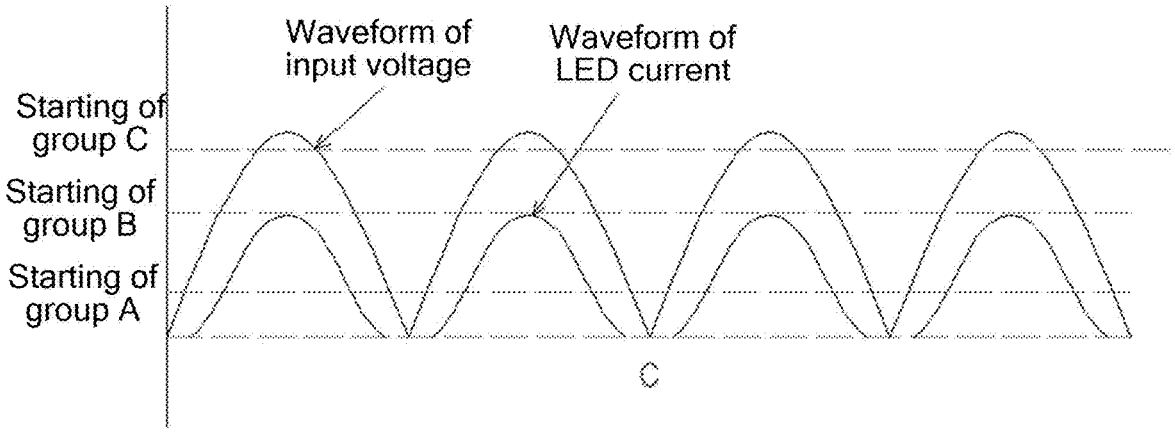
FIG. 4 shows schematic diagrams of an input voltage waveform and an LED current waveform.
Figure 5:
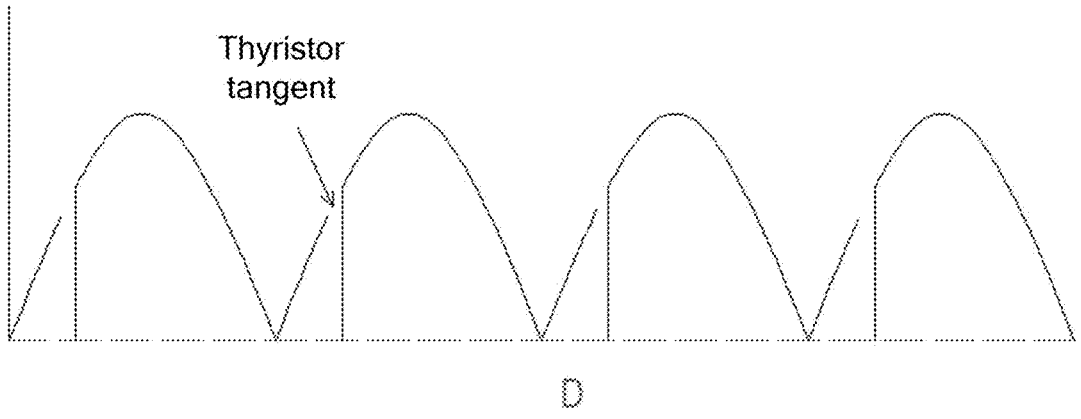
FIG. 5 shows a schematic diagram of change of the input voltage waveform at a thyristor tangent angle.

As shown in FIG. 1 to FIG. 5, the detailed circuit work is as follows: first, a schematic diagram of a minimum module of the LED strip light is shown in FIG. 2, the minimum module is connected to the AC mains electricity, a waveform is shown as a curve A in FIG. 3, and a pulsating DC voltage is obtained after rectification by the B1; as shown in a curve B in FIG. 3, when the voltage rises from 0 and reaches the voltage of the LED lamps in the group A, the Ua is switched on, the LED lamps in the group A, that is, the first LED lamps emit light, and the switching-on current of the Ua is set by Ra; when the voltage continues to rise and reaches the voltage of the LED lamps in the group B, that is, the second LED lamps, the Ub is switched on, the LED lamps in the group B, that is, the second LED lamps emit light, the switching-on current of the Ub is set by Rb, the current of the Ub flows through the Ra, at this time, the Ua is switched off, the LED lamps in the group A and the LED lamps in the group B are connected in series, and the current is determined by the Ub and the Rb; when the voltage continues to rise to normal and reaches the voltage of the LED lamps in the group C, that is, the third LED lamps, the Uc is switched on, the LED lamps in the group C, that is, the third LED lamps emit light, the switching-on current of the Uc is set by Rc, the current of the Uc flows through the Rb and the Ra, at this time, the Ua and the Ub are switched off, the LED lamps in the group A, the LED lamps in the group B and the LED lamps in the group C are connected in series, and the current is determined by the Uc and the Rc; and when the voltage drops, the working process is just opposite to that when the voltage rises. Only three groups of LED lamps are taken for illustrating the above working principle. The working principle is not limited to three groups of LED lamps, each group of LED lamps can be freely combined and adjusted, and the premise is that the number of LED lamps in multiple groups is the same to ensure even linear light emission.

The preferable design of the circuit of the present disclosure is to optimize the harmonics of the LED strip light. According to waveform curves C in FIG. 4, it can be seen that the following performance of the current and input voltage of the LED lamps is excellent, so the circuit can obtain excellent harmonic control and a very high PF value which may be equal to or greater than 0.99 in practical applications to approximately reach an ideal state. Here, the harmonic control principle is the same as the above principle, which is an effect that cannot be achieved by existing LED lamps.

Secondly, the circuit uses the minimum units of the LED strip light. It can be seen that each of the units is directly connected to the mains electricity, it is only necessary to connect a plurality of such units in parallel to the mains electricity and use thyristor dimming to achieve a unified effect, and the length of each group of units can be designed according to the use of the LED strip light. Assuming that the length of each of the minimum units is 0.1 m, there are 10 such units working together in parallel in 1 m. When the LED strip light is used, the LED strip light can be cut into 0.1 m, 0.2 m, 0.8 m, etc. according to a required length, which is very convenient. Generally, the cutting unit of an existing LED strip light is 1 m.

Furthermore, during use, the LED strip light can be directly connected to the mains electricity without an external power supply or a specific dimmer, and original thyristor dimming circuits are shared, so that the use is very convenient, the problem of the size and space of the power supply is not worried about, and the problem of matching of the power of the power supply with the power of the LED strip light is not worried about. The LED strip light is called a drive-free thyristor dimming and color adjusting LED strip light.

When the above circuit is used, some auxiliary functions can be added. For example, a basic fuse or an anti-surge and anti-jamming component circuit can be added in front of a rectifier bridge, which does not conflict when implementing this functional principle. During the layout of an LED lamp board, resistors or jumpers can be conveniently added according to the wiring to facilitate the layout without affecting the principle function.

The above principle is explained by voltage rise and drop processes. We know that thyristor dimming is to control a conduction angle of the thyristor to output the voltage as shown in a curve D in FIG. 5. Regardless of a front tangent or rear tangent mode, the change of the voltage level achieves the above description, and the change of brightness or the simultaneous change of brightness and color temperature or the change of other color modes can be achieved.

The technical characteristics of the above embodiments can be employed in arbitrary combinations. In an effort to provide a concise description of these embodiments, not all possible combinations of all technical characteristics of the embodiments are described; however, these combinations of technical characteristics should be construed as disclosed in the description as long as no contradiction occurs.

The above embodiments only express several implementations of the present disclosure, and the descriptions thereof are relatively specific and detailed, but they should not be thereby interpreted as limiting the scope of the present disclosure. It should be noted that those of ordinary skill in the art can further make several variations and improvements without departing from the idea of the present disclosure, but such variations and improvements shall all fall within the protection scope of the present disclosure. Therefore, the protection scope of the present disclosure shall be subject to the appended claims.

What is claimed is:

1. A thyristor regulation circuit for a high-voltage light-emitting diode (LED) strip light, comprising: a live wire input terminal, a neutral wire input terminal, a full-bridge rectifier module, a first group of LED circuit modules, a second group of LED circuit modules, a third group of LED circuit modules, a first thyristor chip, a second thyristor chip and a third thyristor chip, wherein the live wire input terminal is connected with a first input terminal of the full-bridge rectifier module, the neutral wire input terminal is connected with a second input terminal of the full-bridge rectifier module, a first output terminal of the full-bridge rectifier module is connected with an input terminal of the first group of LED circuit modules, an output terminal of the first group of LED circuit modules is separately connected with an input terminal of the second group of LED circuit modules and an input terminal of the first thyristor chip, an output terminal of the second group of LED circuit modules is separately connected with an input terminal of the third group of LED circuit modules and an input terminal of the second thyristor chip, and an output terminal of the third group of LED circuit modules is connected with an input terminal of the third thyristor chip;

an output terminal of the first thyristor chip, an output terminal of the second thyristor chip and an output terminal of the third thyristor chip are connected to each other and are all grounded;

the first group of LED circuit modules comprises a first parallel group and a second parallel group that are formed by a plurality of first LED lamps, the first LED lamps in the first parallel group are connected in parallel, the first LED lamps in the second parallel group are connected in parallel, the first parallel group and the second parallel group are connected in series, an anode of each of the first LED lamps in the first parallel group is the input terminal of the first group of LED circuit modules, and a cathode of each of the first LED lamps in the second parallel group is the output terminal of the first group of LED circuit modules;

the second group of LED circuit modules comprises a third parallel group, a fourth parallel group and a fifth parallel group that are formed by a plurality of second LED lamps, the second LED lamps in the third parallel group are connected in parallel, the second LED lamps in the fourth parallel group are connected in parallel, the second LED lamps in the fifth parallel group are connected in parallel, the third parallel group, the fourth parallel group and the fifth parallel group are connected in series in sequence, an anode of each of the second LED lamps in the third parallel group is the input terminal of the second group of LED circuit modules, and a cathode of each of the second LED lamps in the fifth parallel group is the output terminal of the second group of LED circuit modules;

the third group of LED circuit modules comprises a sixth parallel group, a seventh parallel group and an eighth parallel group that are formed by a plurality of third LED lamps, the third LED lamps in the sixth parallel group are connected in parallel, the third LED lamps in the seventh parallel group are connected in parallel, the third LED lamps in the eighth parallel group are connected in parallel, the sixth parallel group, the seventh parallel group and the eighth parallel group are connected in series in sequence, an anode of each of the third LED lamps in the sixth parallel group is the input terminal of the third group of LED circuit modules, and a cathode of each of the third LED lamps in the eighth parallel group is the output terminal of the third group of LED circuit modules; and a number of the first LED lamps, a number of the second LED lamps and a number of the third LED lamps are equal, the number of the first LED lamps in the first parallel group is equal to the number of the first LED lamps in the second parallel group, the number of the second LED lamps in the third parallel group, the number of the second LED lamps in the fourth parallel group, the number of the second LED lamps in the fifth parallel group, the number of the third LED lamps in the sixth parallel group, the number of the third LED lamps in the seventh parallel group, and the number of the third LED lamps in the eighth parallel group are equal, and the number of the second LED lamps in the third parallel group is ⅔ of the number of the first LED lamps in the first parallel group.

2. The thyristor regulation circuit according to claim 1, wherein a second output terminal of the full-bridge rectifier module is grounded.

3. The thyristor regulation circuit according to claim 1, wherein the output terminal of the first thyristor chip comprises a first resistor, a first output branch terminal 1 and a first output branch terminal 2, and the first output branch terminal 1 is connected with the first output branch terminal 2 through the first resistor and grounded.

4. The thyristor regulation circuit according to claim 3, wherein the output terminal of the second thyristor chip comprises a second resistor, a second output branch terminal 1 and a second output branch terminal 2, and the second output branch terminal 1 is connected with the second output branch terminal 2 through the second resistor and connected with the first output branch terminal 1.

5. The thyristor regulation circuit according to claim 4, wherein the output terminal of the third thyristor chip comprises a third resistor, a third output branch terminal 1 and a third output branch terminal 2, and the third output branch terminal 1 is connected with the third output branch terminal 2 through the third resistor and connected with the second output branch terminal 1.

6. The thyristor regulation circuit according to claim 1, wherein the number of the first LED lamps is six, the number of the first LED lamps in the first parallel group is three, and the number of the second LED lamps in the third parallel group is two.

7. An LED strip light, comprising a plurality of minimum LED strip light units, wherein the minimum LED strip light units are arranged in parallel, each of the minimum LED strip light units comprises the thyristor regulation circuit for a high-voltage LED strip light according to claim 1, the live wire input terminals are connected to each other, the neutral wire input terminals are connected to each other, each of the first LED lamps, each of the second LED lamps and each of the third LED lamps are attached in one of the minimum LED strip light units, each of the first LED lamps is closely attached to one of the second LED lamps correspondingly, and each of the second LED lamps is closely attached to one of the third LED lamps correspondingly.

* * * * *